US007225902B2

(12) United States Patent
Hashiguchi

(10) Patent No.: US 7,225,902 B2
(45) Date of Patent: Jun. 5, 2007

(54) ELEVATOR

(75) Inventor: Naoki Hashiguchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/567,034

(22) PCT Filed: Jul. 12, 2004

(86) PCT No.: PCT/JP2004/009917

§ 371 (c)(1),
(2), (4) Date: Feb. 3, 2006

(87) PCT Pub. No.: WO2006/006228

PCT Pub. Date: Jan. 19, 2006

(65) Prior Publication Data

US 2006/0231350 A1 Oct. 19, 2006

(51) Int. Cl.
*B66B 11/02* (2006.01)

(52) U.S. Cl. ..... 187/401; 187/406

(58) Field of Classification Search ..... 187/251, 187/254, 264, 401, 406, 351, 356, 370, 371, 187/409; *B66B 13/08, 9/00, 11/02, 7/02*
See application file for complete search history.

(56) References Cited

U.S. PATENT DOCUMENTS

| | | | | |
|---|---|---|---|---|
| 434,849 | A * | 8/1890 | Tracy | 187/351 |
| 1,978,273 | A * | 10/1934 | Lundberg et al. | 187/401 |
| 2,270,441 | A * | 1/1942 | Hymans | 187/264 |
| 5,377,787 | A * | 1/1995 | Chabrier | 187/404 |
| 6,131,703 | A * | 10/2000 | Gates | 187/363 |

FOREIGN PATENT DOCUMENTS

| | | |
|---|---|---|
| JP | 124063/1975 | 10/1975 |
| JP | 1-69489 | 3/1989 |
| JP | 1-145990 | 6/1989 |
| JP | 5-306083 | 11/1993 |
| JP | 6-127868 | 5/1994 |
| JP | 9-165163 | 6/1997 |
| JP | 10-139327 | 5/1998 |
| JP | 11-335039 | 12/1999 |

* cited by examiner

*Primary Examiner*—Gene C. Crawford
*Assistant Examiner*—Stefan Kruer
(74) *Attorney, Agent, or Firm*—Oblon, Spivak, McClelland, Maier & Neustadt, P.C.

(57) ABSTRACT

In an elevator apparatus, a car that is raised and lowered within a hoistway has a car frame and a cage supported on the car frame. Chamfered portions are provided at corner portions of the cage. The car frame has vertical columns arranged along the chamfered portions.

13 Claims, 10 Drawing Sheets

ELEVATOR

TECHNICAL FIELD

The present invention relates to an elevator apparatus in which an elevator car having a car frame and a cage supported on the car frame is raised and lowered within a hoistway.

BACKGROUND ART

In a conventional elevator apparatus, a car guide rail is disposed in a space between a car and a wall of a hoistway. Further, a counterweight is disposed in a space behind the car guide rail within the hoistway. Moreover, a hoisting machine is disposed in a space in front of the car guide rail within the hoistway.

Patent Document 1: JP 09-165163 A

DISCLOSURE OF THE INVENTION

Problem to be Solved by the Invention

In the conventional elevator apparatus, however, a space for disposing the car guide rail between the car and the wall of the hoistway needs to be secured. This entails an increase in the space for the hoistway.

The present invention is made to solve the problem as mentioned above, and has an object of providing an elevator apparatus enabling a further reduction in the space for a hoistway.

Means for Solving the Problem

An elevator apparatus according to the present invention includes a car raised and lowered within a hoistway, the car having a car frame and a cage supported on the car frame, in which the cage has a chamfered portion provided at a corner portion thereof, and in which the car frame has a vertical column arranged along the chamfered portion.

An elevator apparatus according to the present invention includes a car raised and lowered within a hoistway, the car having a car frame including a vertical column and a cage supported on the car frame, in which the cage has a recess provided in a side face thereof and the vertical column is at least partially disposed within the recess.

BEST MODE FOR CARRYING OUT THE INVENTION

Hereinbelow, preferred embodiments of the present invention will be described with reference to the drawings.

Embodiment 1

Figure 1:
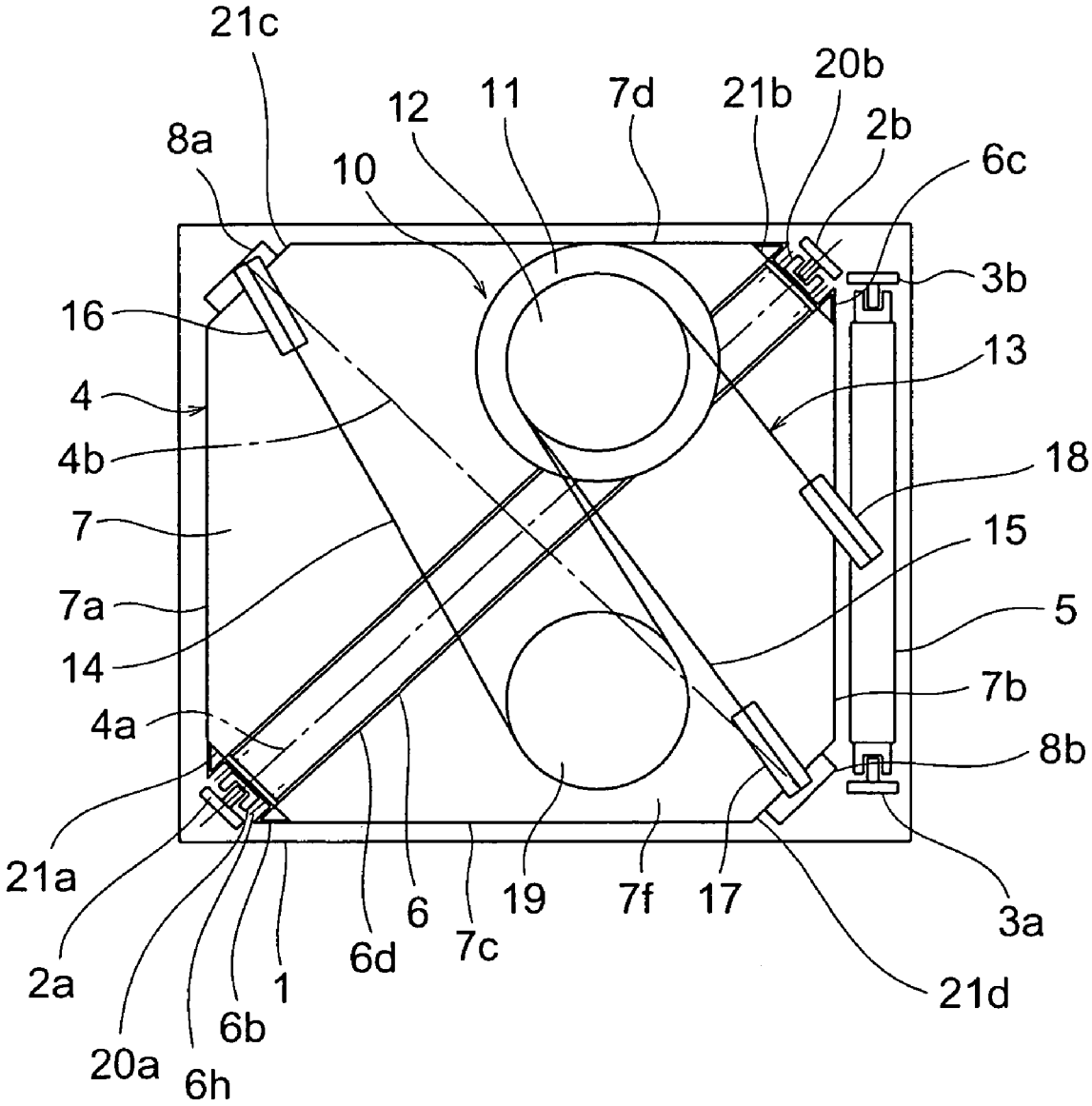
FIG. 1 is a plan view showing an elevator apparatus according to Embodiment 1 of the present invention.
Figure 2:
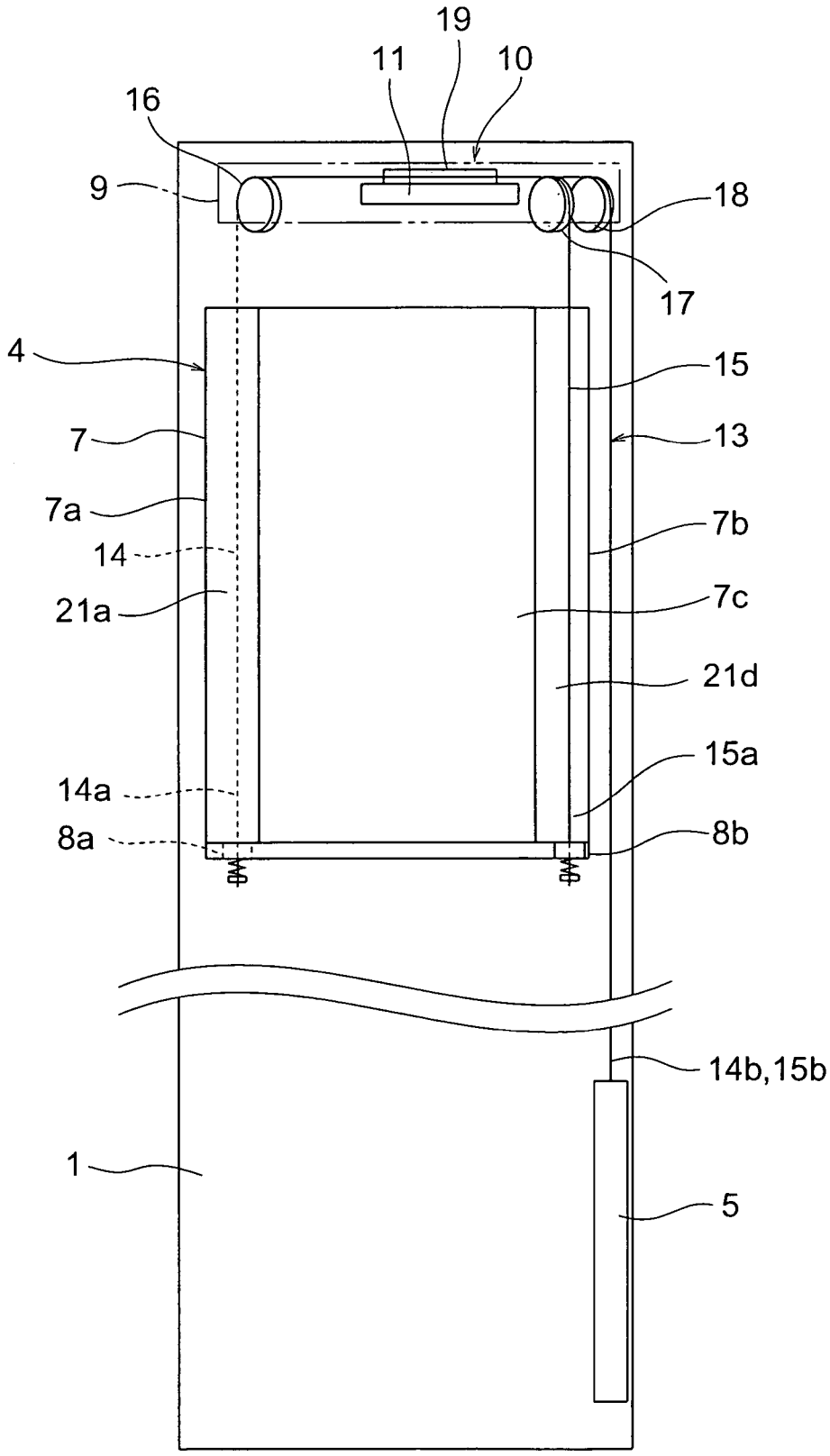
FIG. 2 is a side view showing the elevator apparatus shown in FIG. 1.
Figure 3:
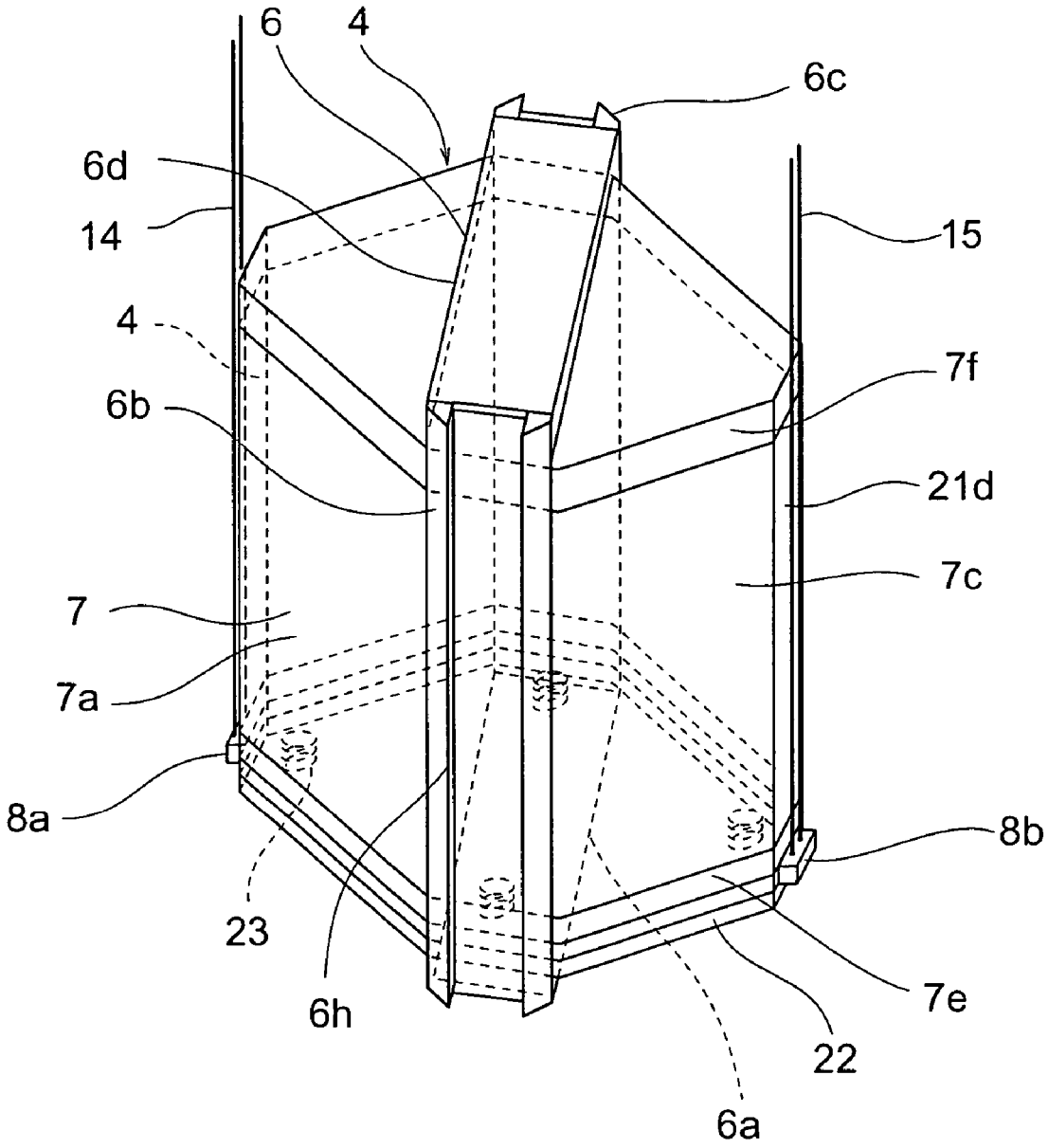
FIG. 3 is a perspective view showing a car shown in FIG. 1.

FIG. 1 is a plan view showing an elevator apparatus (machine room-less elevator) according to Embodiment 1 of the present invention, FIG. 2 is a side view showing the elevator apparatus shown in FIG. 1, and FIG. 3 is a perspective view showing a car shown in FIG. 1.

Referring to the figures, first and second car guide rails 2*a*, 2*b* and first and second counterweight guide rails 3*a*, 3*b* are disposed within a hoistway 1(in FIG. 2, the guide rails 2*a*, 2*b*, 3*a*, 3*b* are omitted). Each of the guide rails 2*a*, 2*b*, 3*a*, 3*b* has a T-shaped cross-section. The car guide rails 2*a*, 2*b* are opposed to each other.

A car 4 is raised and lowered within the hoistway 1 while being guided by the car guide rails 2*a*, 2*b*. As seen in the vertical projection plane, the car guide rails 2*a*, 2*b* are disposed on the extension of a first diagonal line 4*a* of the car 4. A counterweight 5 is raised and lowered within the hoistway 1 while being guided by the counterweight guide rails 3*a*, 3*b*.

First and second rope connecting portions 8*a*, 8*b* are provided in a lower portion of the car 4. As seen in the vertical projection plane, the rope connecting portions 8*a*, 8*b* are disposed on a second diagonal line 4*b* of the car 4.

A support frame 9 (FIG. 2) is disposed in an upper portion of the hoistway 1. The support frame 9 is at least partially supported by the car guide rails 2*a*, 2*b* and the counterweight guide rails 3*a*, 3*b*. Alternatively, the support frame 9 may be supported by a support portion provided to a building.

The support frame 9 supports a drive device (hoisting machine) 10 that generates a driving force for raising and lowering the car 4 and the counterweight 5. The drive device 10 has a drive device main body 11 including a motor and a brake, and a drive sheave 12 rotated by the drive device main body 11.

In this example, the drive sheave 12 is arranged on the drive device main body 11. Further, the drive sheave 12 is directly driven by the motor of the drive device main body 11 without the intervention of a decelerating mechanism.

Further, the drive device 10 is disposed horizontally (or substantially horizontally) such that a rotary shaft of the drive sheave 12 extends vertically (or substantially vertically) Employed as the drive device 10 is a thin hoisting machine having an axial dimension that is smaller than an outer diameter dimension in a direction perpendicular to the axial direction.

Moreover, the drive device 10 entirely or substantially entirely overlaps the car 4 as seen in the vertical projection plane. In other words, the drive device 10 is disposed directly above the car 4.

A main rope group 13 for suspending the car 4 and the counterweight 5 within the hoistway 1 is wound around the drive sheave 12. The main rope group 13 includes a plurality of first main ropes 14 (only one of which is shown in FIGS.

1 and 2) and a plurality of second main ropes 15 (only one of which is shown in FIGS. 1 and 2).

The car 4 and the counterweight 5 are suspended according to a 1:1 roping method by means of the main rope group 13.

Each first main rope 14 has a first end portion 14*a* connected to the first rope connecting portion 8*a*, and a second end portion 14*b* connected to an upper portion of the counterweight 5. Each second main rope 15 has a third end portion 15*a* connected to the second rope connecting portion 8*b*, and a fourth end portion 15*b* connected to the upper portion of the counterweight 5.

A first pulley 16 for guiding the first main rope 14 to the first rope connecting portion 8*a*, a second pulley 17 for guiding the second main rope 15 to the second rope connecting portion 8*b*, a third pulley 18 for guiding the first and second main ropes 14, 15 to the counterweight 5, and a deflection pulley 19 for guiding the first main rope 14 extending from the drive sheave 12 to the first pulley 16 are mounted on the support frame 9.

The first pulley 16 is disposed directly above the first rope connecting portion 8*a*. The second pulley 17 is disposed directly above the second rope connecting portion 8*b*.

The first to third pulleys 16 to 18 are disposed such that their respective rotary shafts extend horizontally. The deflection pulley 19 is disposed such that its rotary shaft extends vertically (or substantially vertically). Further, the deflection pulley 19 is disposed at the same position as the drive sheave 12 with respect to the depth direction of the car 4 (the right-to-left direction in FIG. 1).

The drive device 10 and the pulleys 16 to 19 are mounted on the common support frame 9 and unitized.

The car 4 has a car frame 6 (omitted in FIG. 2), a car floor platform 22 (FIG. 3) supported on the car frame 6, a cage 7 supported on the car floor platform 22, and a plurality of rubber cushions 23 (FIG. 3) interposed between the car floor platform 22 and the cage 7.

The wall portion of the cage 7 has a front face 7*a* provided with a car entrance (not shown), a back face 7*b* opposed to the front face, a first side face 7*c*, a second side face 7*d* opposed to the first side face 7*c*, a car floor 7*e*, and a ceiling portion 7*f*.

As seen in the vertical projection plane, the first diagonal line 4*a* is a straight line connecting the corner portion between the front face 7*a* and the first side face 7*c* to the corner portion between the back face 7*b* and the second side face 7*d*. The second diagonal line 4*b* is a straight line connecting a corner portion between the back face 7*b* and the first side face 7*c* to a corner portion between the front face 7*a* and the second side face 7*d*.

The counterweight 5 is disposed behind the car 4 so as to be opposed to the back face 6*b* when located at the same height as the car 4.

A first chamfered portion 21*a* is provided at the corner portion between the front face 7*a* and first side face 7*c* of the cage 7. A second chamfered portion 21*b* is provided at the corner portion between the back face 7*b* and second side face 7*d* of the cage 7. A third chamfered portion 21*c* is provided at the corner portion between the front face 7*a* and second side face 7*d* of the cage 7. A fourth chamfered portion 21*d* is provided at the corner portion between the back face 7*b* and first side face 7*c* of the cage 7.

The chamfered portions 21*a* to 21*d* are formed as so to chamfer the four corners of the rectangular cage 6 as seen in the vertical projection plane. In other words, the chamfered portions 21*a* to 21*d* can also be referred to as notched corner portions, or notched cross-section portions. The first chamfered portion 21*a* and the second chamfered portion 21*b* are parallel or substantially parallel to each other. The third chamfered portion 21*c* and the fourth chamfered portion 21*d* are parallel or substantially parallel to each other.

The chamfered portions 21*a* to 21*d* are continuously provided along the raising and lowering direction (vertical direction) of the car 4. Although the floor surface area of the cage 7 slightly decreases due to the provision of the chamfered portions 21*a*, 21*b*, such a decrease in floor surface area is not so large as to affect the passenger capacity of the elevator.

As seen in the vertical projection plane, the first and second rope connecting portions 8*a*, 8*b* are disposed so as to protrude from the third and fourth chamfered portions 21*c*, 21*d*, respectively. As a result, the first main rope 14 is disposed so as to be partially opposed to the third chamfered portion 21*c*. Further, the second main rope 15 is disposed so as to be partially opposed to the fourth chamfered portion 21*d*.

The car frame 6 has a horizontal lower beam 6*a* supporting the car floor platform 22, vertical first and second vertical columns 6*b*, 6*c* that are parallel to each other, and a horizontal upper beam 6*d* disposed between respective lower end portions of the vertical columns 6*b*, 6*c*. The lower beam 6*a* is disposed between the vertical columns 6*b*, 6*c*. The lower beam 6*a* is disposed between the vertical columns 6*b*, 6*c*. The first and second rope connecting portions 8*a*, 8*b* are fixed to the car floor platform 22.

As seen in the vertical projection plane, the lower beam 6*a* and the upper beam 6*d* are disposed along the first diagonal line 4*a* of the car 4. The vertical columns 6*b*, 6*c* are disposed along the first and second chamfered portions 21*a*, 21*b*. That is, the vertical columns 6*b*, 6*c* are disposed in spaces adjacent to the chamfered portions 2l*a*, 21*b*, respectively. Further, the back faces of the vertical columns 6*b*, 6*c* are bonded to the first and second chamfered portions 21*a*, 21*b*, respectively. Further, the cage 7 is fixed to the vertical columns 6*b*, 6*c* at the first and second chamfered portions 21*a*, 21*b*, respectively, by means of fastening members such as bolts.

The vertical columns 6*b*, 6*c* are opposed to the car guide rails 2*a*, 2*b*, respectively. A groove portion (recess) 6*h* that extends continuously in the vertical direction is formed in each of the faces of the vertical columns 6*b*, 6*c* opposed to the car guide rails 2*a*, 2*b*, respectively. Conversely stated, the car guide rails 2*a*, 2*b* are each disposed so as to face the groove portion 6*h*.

At least a part of a first guide shoe 20*a* that engages with the first car guide rail 2*a* is disposed within the groove portion 6*h* of the first vertical column 6*b*. At least a part of a second guide shoe 20*b* that engages with the second car guide rail 2*b* is disposed within the groove portion 6*h* of the second vertical column 6*c*. In this example, the entire car guide shoes 20*a*, 20*b* are each received within the groove portion 6*h*.

As the car guide shoes 20*a*, 20*b*, there can be used, for example, sliding guide shoes or roller guide shoes.

Figure 4:
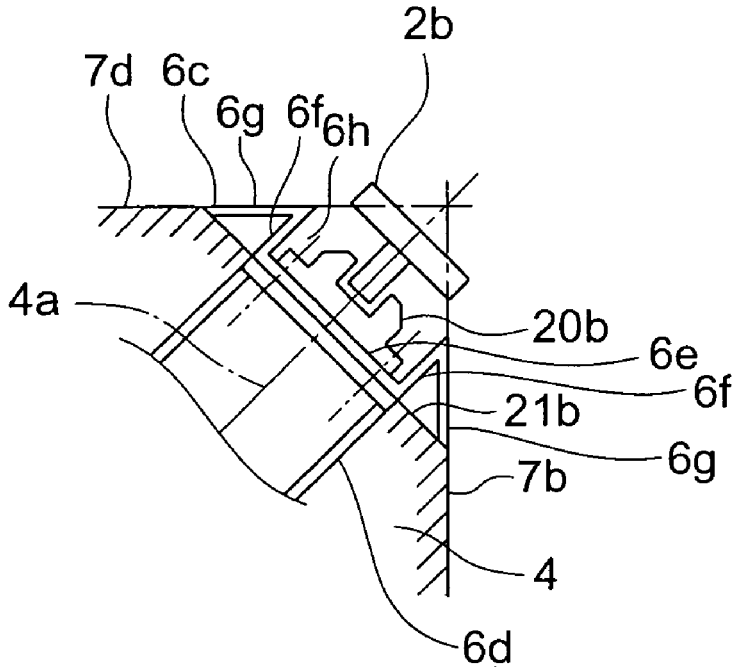
FIG. 4 is an enlarged main-portion plan view of FIG. 1.

FIG. 4 is an enlarged main-portion plan view of FIG. 1. As shown in FIG. 4, as seen in the vertical projection plane, the vertical column 6*c* and the second car guide shoe 20*b* are disposed inside a triangular region (vertical-column installing region) surrounded by a straight line obtained by extending the back face 7*b*, a straight line obtained by extending the second side face 7*d*, and a surface of the second chamfered portion 21*b*. Likewise, as seen in the vertical projection plane, the vertical column 6*b* and the first car guide shoe 20*a* are disposed inside a triangular region (vertical-column installing region) surrounded by a straight line obtained by extending the front face 7*a*, a straight line obtained by extending the first side face 7*c*, and a surface of the first chamfered portion 21*a*.

It is desirable that the car guide shoes 20*a*, 20*b* be so disposed as to be accommodated in the groove portion 6*h* of the vertical columns 6*b*, 6*c*, respectively, by 80% or more as seen in their cross-sections.

Further, as seen in the vertical projection plane, the car guide rails 2*a*, 2*b* are at least partially disposed in the groove portion 6*h* of the vertical columns 6*b*, 6*c*, respectively.

The vertical columns 6*b*, 6*c* each have a first part 6*e* respectively bonded to the chamfered portions 21*a*, 21*b*, a pair of second parts 6*f* extending at a right angle to the first part 6*e* from the opposite end portions of the first part 6*e*, and a pair of third parts 6*g* respectively extending from the distal ends of the second parts 6*f* toward the chamfered portions 21*a*, 21. The first to third parts 6*e* to 6*g* are each formed by bending a steel plate. By adopting such a bending structure, the strength of the vertical columns 6*b*, 6*c* against toppling, twisting, and bending is enhanced.

The groove portion 6*h* is formed by the first part 6*e* and the second part 6*f*. The car guide shoes 20*a*, 20*b* are each attached to the first part 6*e*. The third part 6*g* is flush with the side face (the front face 7*a*, the back face 7*b*, the first side face 7*c*, or the second side face 7*d*) of the cage 7 adjacent thereto.

Figure 5:
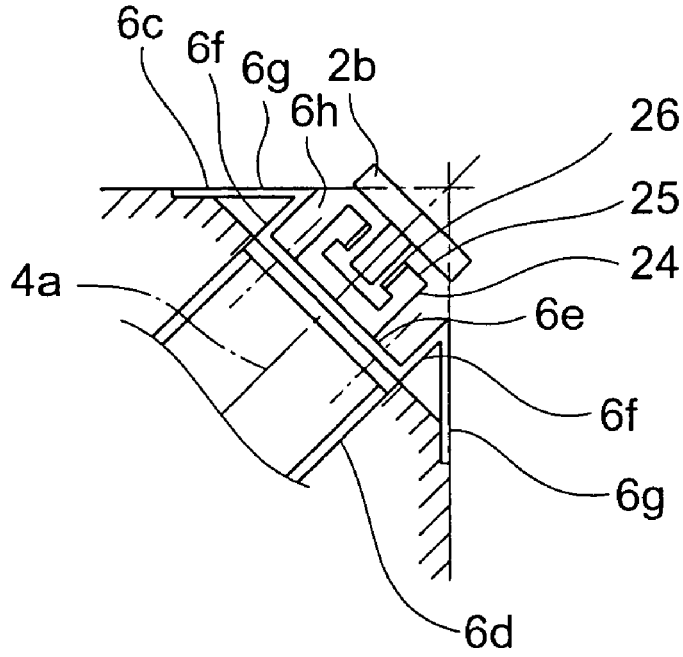
FIG. 5 is a plan view showing a safety device of the elevator apparatus shown in FIG. 1.

Further, as shown in FIG. 5, as seen in the vertical projection plane, at least a part of a safety device 24 for bringing the car 4 to an emergency stop protrudes from each of the chamfered portions 21*a*, 21*b* to be disposed within the groove portion 6*h* of each of the vertical columns 6*b*, 6*c*, respectively. In this example, the entire engaging portion of the safety device 24 with each of the car guide rails 2*a*, 2*b* is received within the groove portion 6*h*.

The safety device 24 may be a mechanical device operating through the transmission of a mechanical operating force or an electric device having an actuator that operates in response to an electric actuation signal.

The safety device 24 has a fixed portion 25 fixed to the car 4 side, and a braking member (wedge member) 26 provided slidably on the inner side of the fixed portion 25. When the safety device 24 is actuated, the braking member 26 is displaced upwards with respect to the car 4 along the slide/guide surface of the fixed portion 25. As a result, the braking member 26 is wedged in between the slide/guide surface and a side face of each of the car guide rails 2*a*, 2*b*, so the car guide rails 2*a*, 2*b* are each pinched between the fixed portion 25 and the braking member 26 to thereby bring the car 4 to an emergency stop.

Further, as shown in FIG. 5, the third part 6*g* of each of the vertical columns 6*b*, 6*c* may be bonded and fixed to the front face 7*a* or the back face 7*b* and to the first side face 7*c* or the second side face 7*d*.

In the elevator apparatus as described above, the vertical columns 6*b*, 6*c* are disposed in the chamfered portions 2l*a*, 21*b* provided at the corner portions of the cage 7, so the vertical columns 6*b*, 6*c* do not protrude from the side faces 7*c*, 7*d* of the cage 7, respectively. Accordingly, it is possible to achieve a reduction in the installation space for the elevator apparatus in the width direction of the car 4, thereby enabling a further reduction in hoistway space.

The hoistway space can be more effectively reduced particularly when the reduction in the horizontal cross-sectional area of the hoistway 1 due to the provision of the chamfered portions 21*a*, 21*b* is larger than the reduction in the horizontal cross-sectional area of the cage 7 due to the provision of the chamfered portions 21*a*, 21*b*.

Further, in the case where elevator apparatuses are arranged in parallel, it is possible to minimize the distance between the cars of the adjacent elevator apparatuses, thereby enabling an effective reduction in the hoistway space as a whole.

Further, the car guide shoes 20*a*, 20*b* and the car guide rails 2*a*, 2*b* are disposed within the groove portions 6*h* of the vertical columns 6*b*, 6*c*, respectively, thereby enabling a further reduction in the hoistway space.

Furthermore, as seen in the vertical projection plane, at least a part of the safety device 24 is disposed within the groove portion 6*h* of each of the vertical columns 6*b*, 6*c*, thereby making it possible to prevent the safety device 24 from protruding from the car 4. This enables a reduction in the installation space for the elevator apparatus in the width direction of the car 4 and hence a further reduction in the hoistway space.

Further, the chamfered portions 21*a* to 21*d* are provided at the four corners of the cage 7, respectively. Accordingly, when the car 4 and the counterweight 5 pass each other within the narrow hoistway 1, air can be released through the spaces formed by the chamfered portions 21*a* to 21*d*, thereby making it possible to prevent an impact sound or vibration from being generated as the car 4 and the counterweight 5 pass each other.

Further, as seen in the vertical projection plane, the rope connecting portions 8*a*, 8*b* protrude from the chamfered portions 21*c*, 21*d*, respectively, so it is possible to achieve a further reduction in the installation space for the elevator apparatus in the width direction of the car 4, thereby enabling a further reduction in the hoistway space.

It should be noted that while in the above-described example the surfaces of the chamfered portions 21*a* to 21*d* are flat, they may also be curved.

Further, while the first to fourth chamfered portions 21*a* to 21*d* are provided in the above-described example, there may be provided only the first and second chamfered portions 21*a*, 21*b*. In this case, as shown in FIG. 6, for example, the rope connecting portions 8*a*, 8*b* may be disposed so as to protrude slightly from the side faces 7*c*, 7*d* of the cage 7, respectively.

Embodiment 2

Figure 6:
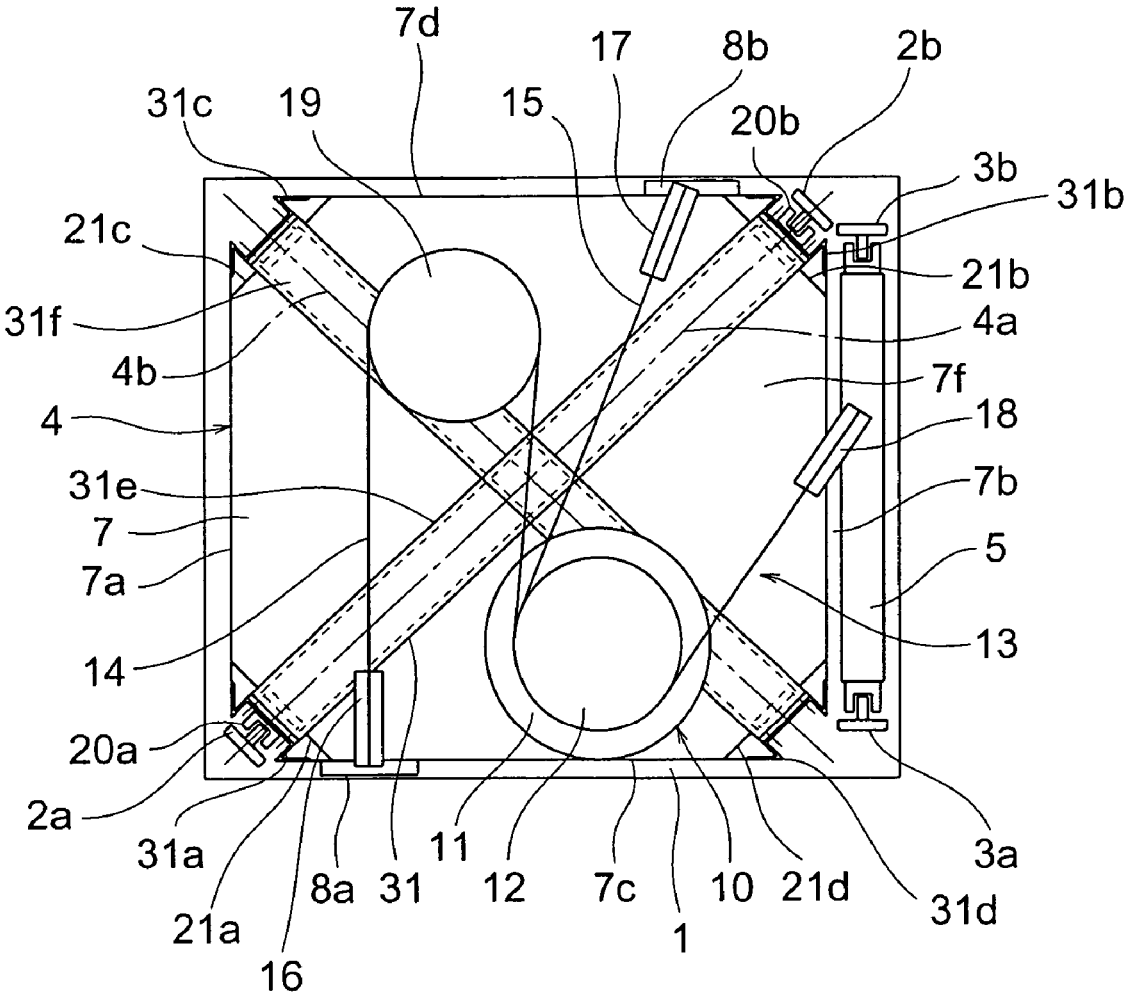
FIG. 6 is a plan view showing an elevator apparatus according to Embodiment 2 of the present invention.

Next, FIG. 6 is a plan view showing an elevator apparatus according to Embodiment 2 of the present invention. Referring to FIG. 6, a car 4 has a car frame 31 and a cage 7 supported on the car frame 31.

The car frame 31 has first and second lower beams (not shown) extending horizontally and supporting the cage 7, first to fourth vertical columns 31*a* to 31*d* that are parallel to each other, a first horizontal upper beam 31*e* disposed between the upper end portions of the vertical columns 31*a*, 31*b*, and a second horizontal upper beam 31*f* disposed between the upper end portions of the vertical columns 31*c*, 31*d*. The first lower beam is disposed between the lower end portions of the vertical columns 31*a*, 31*bc*. The second lower beam is disposed between the lower end portions of the vertical columns 31*c*, 31*d*.

As seen in the vertical projection plane, the first lower beam and the first upper beam 31*e* are disposed along the first diagonal line 4*a* of the car 4. As seen in the vertical projection plane, the second lower beam and the second upper beam 31*f* are disposed along the second diagonal line 4*b* of the car 4. That is, the first lower beam and the second lower beam cross each other in a lower portion of the cage 7. Further, the first upper beam 31*e* and the second upper beam 31*f* cross each other above the cage 7.

The vertical columns 31*a*, 31*b* are disposed along the first and second chamfered portions 21*a*, 21*b*, respectively. That is, the vertical columns 31*a*, 31*b* are disposed in spaces adjacent to the chamfered portions 21*a*, 21*b*, respectively. Further, the back surfaces of the vertical columns 31*a*, 31*b* are bonded to the first and second chamfered portions 21*a*, 21*b*, respectively. Further, the cage 7 is fixed to the vertical columns 31*a*, 31*b* at the first and second chamfered portions 21*a*, 21*d*, respectively, by means of fastening members such as bolts.

The vertical columns 31*c*, 31*d* are disposed along the third and fourth chamfered portions 21*c*, 21*d*, respectively. That is, the vertical columns 31*c*, 31*d* are disposed in spaces adjacent to the chamfered portions 21*c*, 21*d*, respectively. Further, the back surfaces of the vertical columns 31*c*, 31*d* are bonded to the third and fourth chamfered portions 21*c*, 21*d*, respectively. Further, the cage 7 is fixed to the vertical columns 31*c*, 31*d* at the third and fourth chamfered portions 21*c*, 21*d*, respectively, by means of fastening members such as bolts.

As seen in the vertical projection plane, the first and second rope connecting portions 8*a*, 8*b* protrude outwards from the first and second side faces 7*c*, 7*d*, respectively, in the width direction of the car 4. Otherwise, Embodiment 2 is of the same construction as Embodiment 1.

In the elevator apparatus as described above, the vertical columns 31*a* to 31*d* are disposed at the four corners of the car 4, thereby making it possible to enhance the strength of the car frame 31. Further, the first lower beam and the second lower beam cross each other, and the first upper beam 31*e* and the second upper beam 31*f* cross each other, thereby making it possible to further enhance the strength of the car frame 31.

It should be noted that as in Embodiment 1, the rope connecting portions 8*a*, 8*b* can be disposed so as to protrude from the chamfered portions 21*c*, 21*d*, respectively.

Embodiment 3

Figure 7:
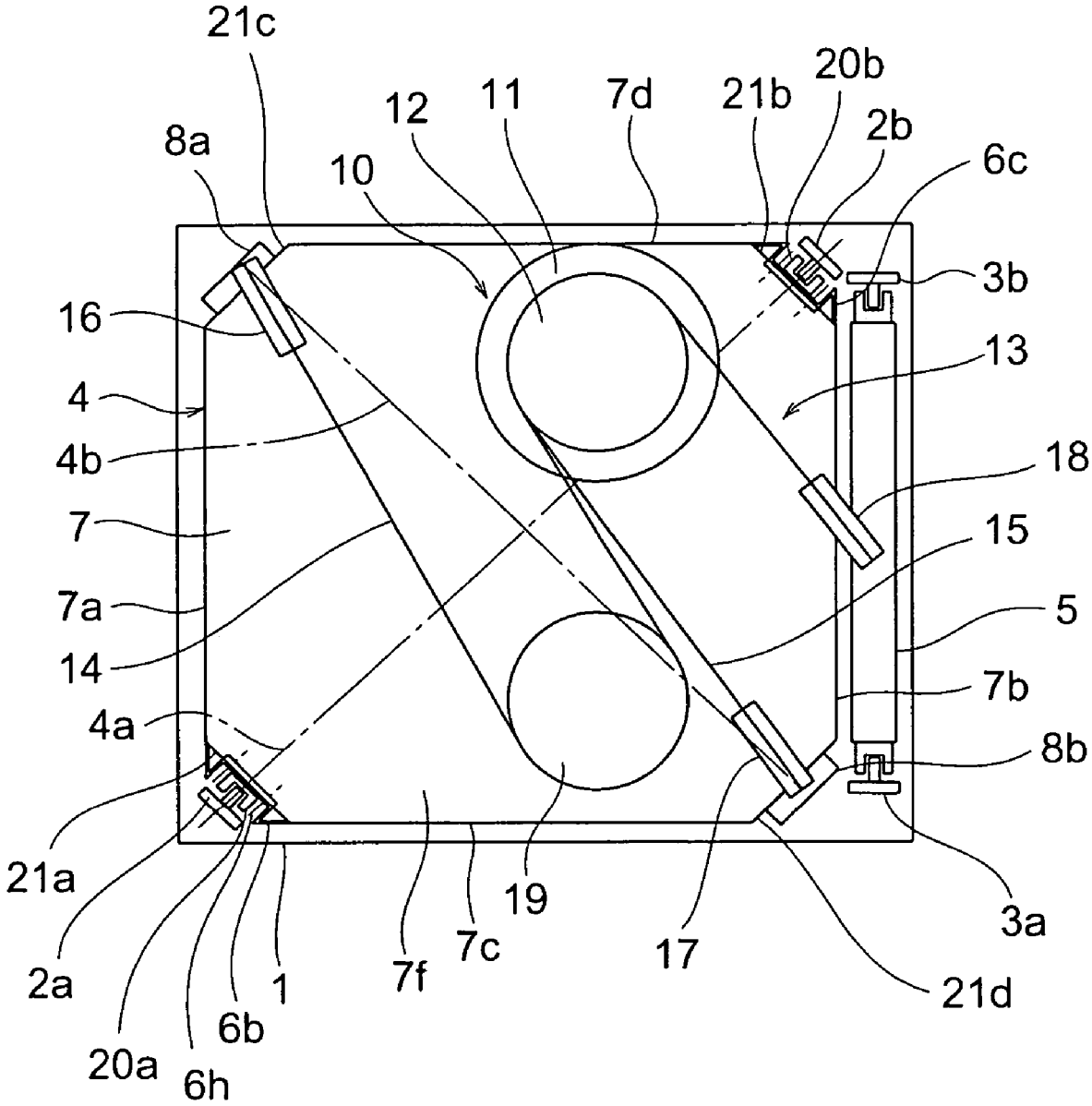
FIG. 7 is a plan view showing an elevator apparatus according to Embodiment 3 of the present invention.
Figure 8:
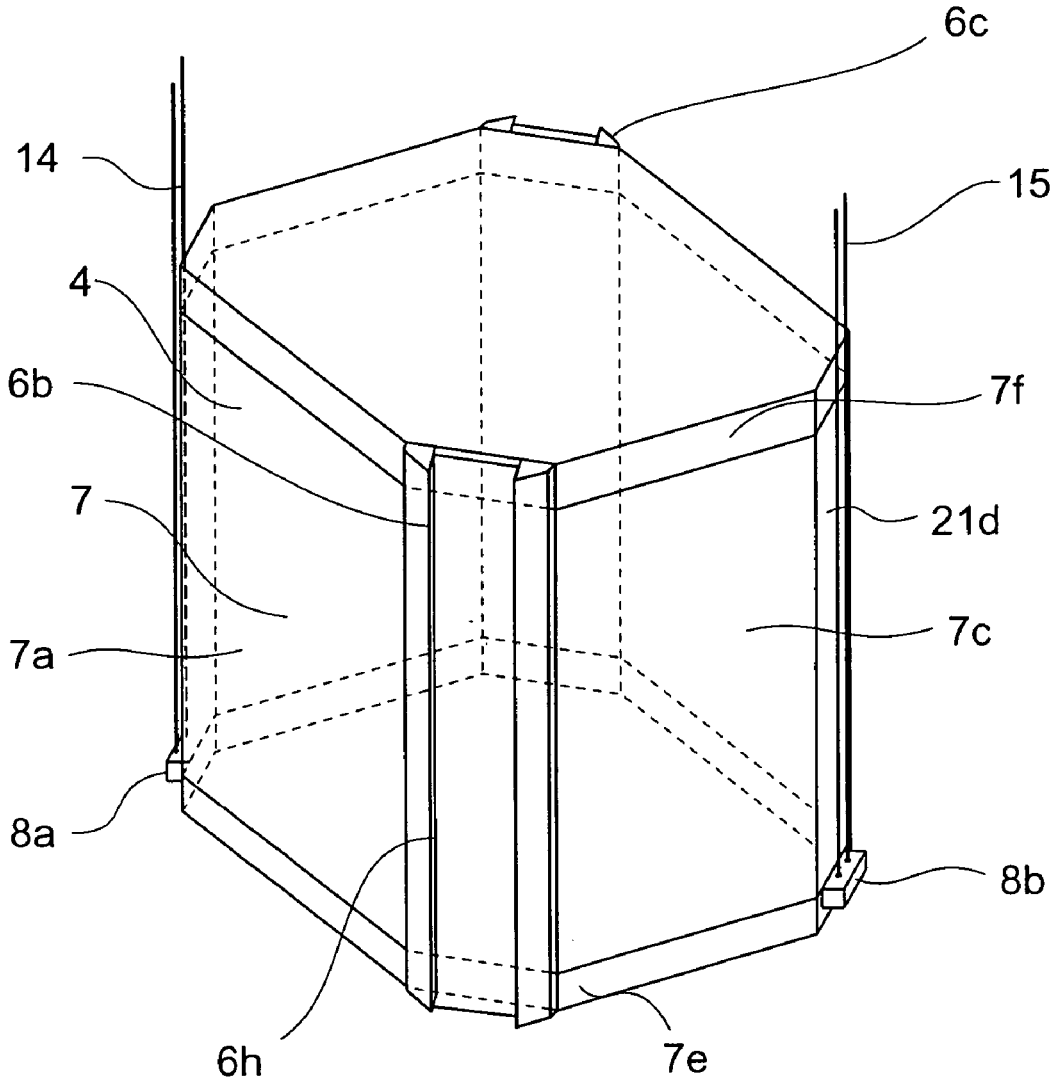
FIG. 8 is a perspective view showing a car shown in FIG. 7.
Figure 9:
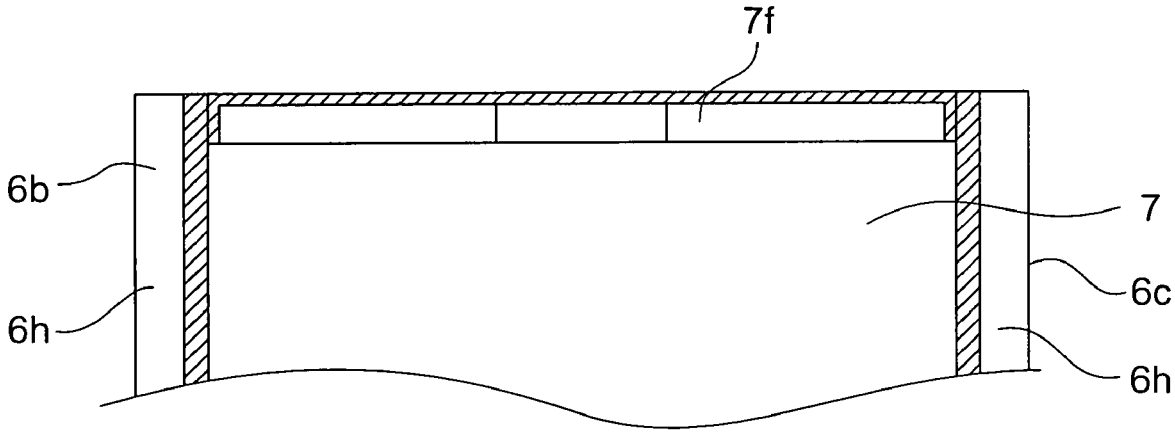
FIG. 9 is a main-portion sectional view showing the car shown in FIG. 7.

Next, FIG. 7 is a plan view showing an elevator apparatus according to Embodiment 3 of the present invention, FIG. 8 is a perspective view showing a car shown in FIG. 7, and FIG. 9 is a main-portion sectional view of the car shown in FIG. 7. In this example, the rigidity of the ceiling portion 7*f* of the cage 7 is enhanced to thereby omit the upper beam, the rigidity of the car floor 7*e* is enhanced to thereby omit the lower beam. In other words, the ceiling portion 7*f* and the car floor 7*e* each serve as a part of the car frame. Otherwise, Embodiment 3 is of the same construction as Embodiment 1.

According to the elevator apparatus as described above, the upper beam and the lower beam are omitted, whereby the vertical dimension of the car 4 can be reduced to thereby achieve a reduction in the vertical dimension of the hoistway 1.

Embodiment 4

Figure 10:
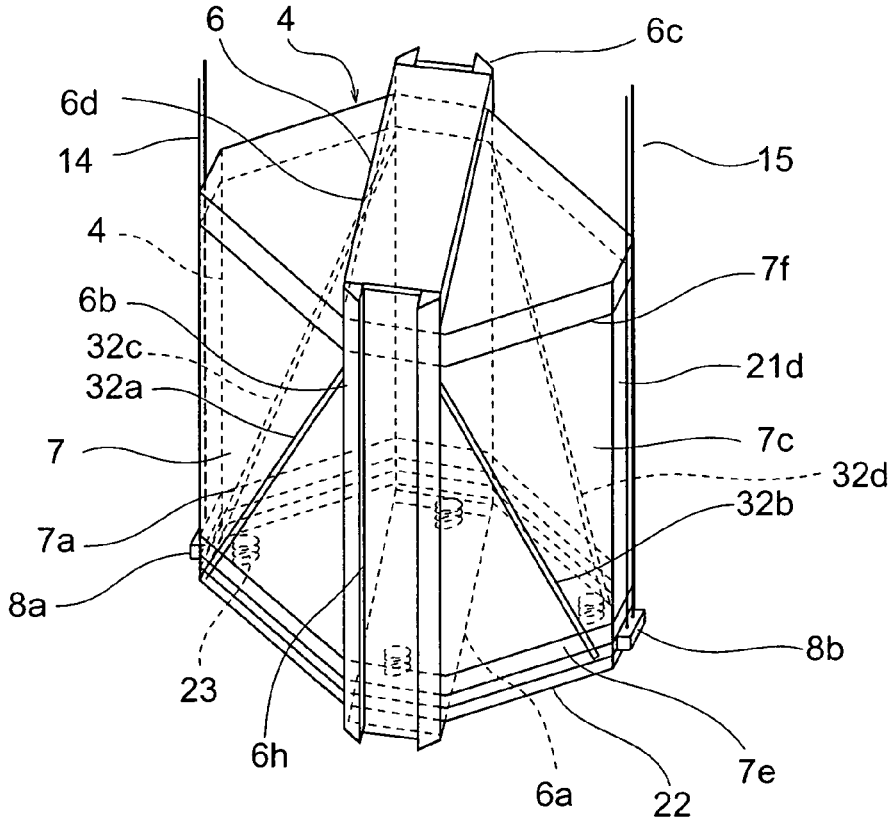
FIG. 10 is a perspective view showing an elevator apparatus according to Embodiment 4 of the present invention.

Next, FIG. 10 is a perspective view showing a car of an elevator apparatus according to Embodiment 4 of the present invention. Referring to FIG. 10, first to fourth reinforcing members (diagonal braces) 32*a* to 32*d* are provided between the car floor platform 22 and each of the vertical columns 6*b*, 6*c*. Otherwise, Embodiment 4 is of the same construction as Embodiment 1.

Figure 11:
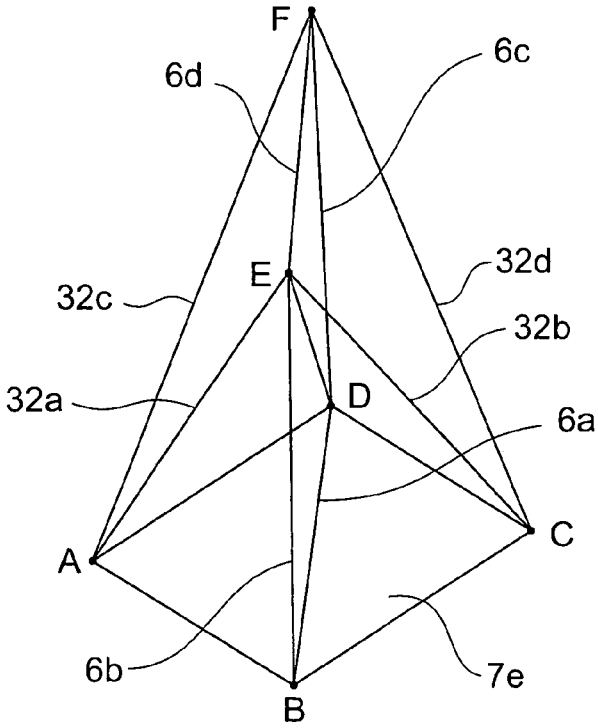
FIG. 11 is an explanatory diagram schematically showing the structure of a car frame shown in FIG. 10.

FIG. 11 is an explanatory diagram schematically showing the structure of the car frame 6 shown in FIG. 10. By providing the reinforcing members 32*a* to 32*d*, intersection points E, F between the upper beam 6*d* and the vertical columns 6*b*, 6*c*, respectively, and points A, B, C, D at the four corners of the car floor platform 22 are substantially connected to each other through the reinforcing members 32*a* to 32*d*, thereby enhancing the strength of the car frame 6. That is, all the strength members excluding the car floor platform 22 form triangular strength spaces (ΔEAB, ΔEBC, ΔEFA, ΔECF, ΔFCD, ΔFDA), thus constituting a heptahedron formed by the points A to F. Accordingly, a high-strength structural body can be constructed despite the simple structure.

Embodiment 5

Figure 12:
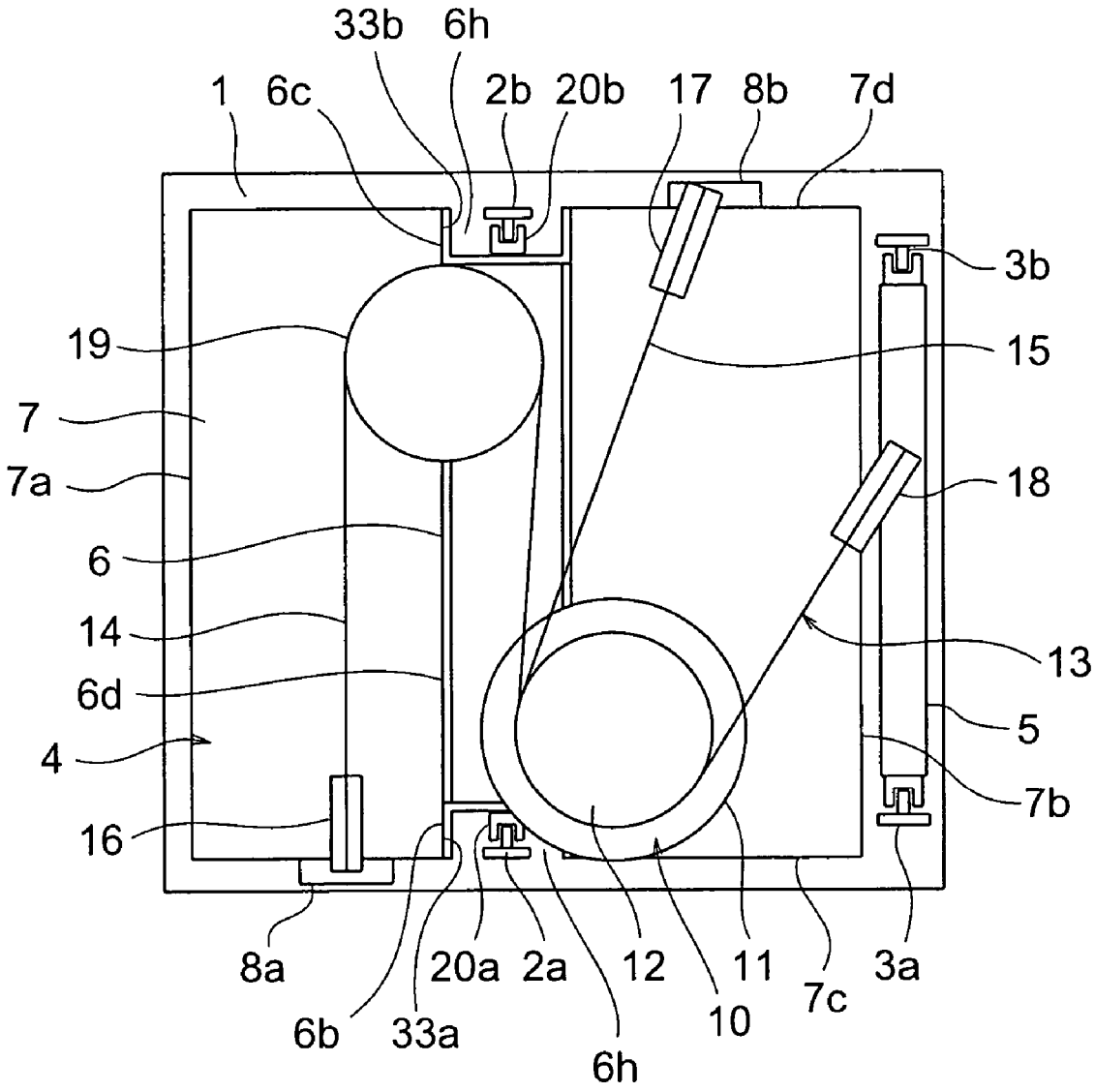
FIG. 12 is a plan view showing an elevator apparatus according to Embodiment 5 of the present invention.

Next, FIG. 12 is a plan view showing an elevator apparatus according to Embodiment 5 of the present invention. Referring to FIG. 12, first and second recesses 33*a*, 33*b* are provided in the side faces 7*c*, 7*d* of the cage 7, respectively. The first and second recesses 33*a*, 33*b* are provided continuously along the raising and lowering direction (vertical direction) of the car 4. That is, the first and second recesses 33*a*, 33*b* are formed in a groove-like fashion.

Slight protrusions are formed inside the car 6 due to the provision of the first and second recesses 33*a*, 33*b*. However, those protrusions are not so large as to affect the passenger capacity.

The vertical columns 6*b*, 6*c* are at least partially disposed within the recesses 33*a*, 33*b*, respectively. In this example, the entire vertical columns 6*b*, 6*c* are disposed within the recesses 33*a*, 33*b*, respectively. The car guide shoes 20*a*, 20*b* are at least partially received within the groove portions 6*h* of the vertical columns 6*b*, 6*c*, respectively. In this example, the car guide shoes 20*a*, 20*b* are each entirely received within the groove portion 6*h*. Further, in this example, the car guide rails 2*a*, 2*b* are each also entirely received within the groove portion 6*h*.

The first and second recesses 33*a*, 33*b* are provided at the same position in the depth direction of the cage 6. Accordingly, the vertical columns 6*b*, 6*c* are also provided at the same position in the depth direction of the cage 6. As a result, the upper beam 6*d* and lower beam (not shown) of the car frame 6 are disposed in parallel to each other in the width direction of the car 4.

As seen in the vertical projection plane, the first and second rope connecting portions 8*a*, 8*b* protrude from the first side face 6*c* and the second side face 6*d*, respectively. Further, as seen in the vertical projection plane, the first and second rope connecting portions 8*a*, 8*b* are disposed at symmetrical or substantially symmetrical positions with respect to the center of gravity of the car 4.

Further, the first rope connecting portion 8*a* is disposed forward of the first car guide rail 2*a* with respect to the depth direction of the car 4. The second rope connecting portion 8*b* is disposed rearward of the second car guide rail 2*b* with respect to the depth direction of the car 4.

In Embodiment 1, the vertical columns 6*b*, 6*c* are respectively disposed along the chamfered portions 21*a*, 21*b* provided at the corner portions of the cage 7. However, also by providing the recesses 33*a*, 33*b* in the side faces 7*c*, 7*d* of the cage 7 and disposing the vertical columns 6*b*, 6*c* within the recesses 33*a*, 33*b*, the installation space for the elevator apparatus in the width direction of the car 4 can be reduced without the vertical columns 6*b*, 6*c* protruding from the side faces 7*c*, 7*b* of the cage 7, respectively, thereby enabling a further reduction in the hoistway space.

While in Embodiment 5 the recesses 33*a*, 33*b* are provided at the same position in the depth direction of the car 4, the recesses 33*a*, 33*b* may be provided in a longitudinally staggered arrangement.

Further, instead of the chamfered portions as described in Embodiment 1, the recesses as described in Embodiment 5 may be provided at the corner portions of the cage, with the vertical columns being received within those recesses.

Further, while in the above-described examples there are provided the two rope connecting portions 8*a*, 8*b* that are separate from each other, there may be provided only one connecting portion. Further, the rope connecting portions may be provided in the upper beam, for example.

Furthermore, while the above-described examples are directed to the elevator apparatus of the 1:1 roping system, the roping system is not limited to this. For example, the present invention is also applicable to an elevator apparatus of a 2:1 roping system.

Further, the counterweight may be disposed by the side of the car so that the counterweight is opposed to one side face of the car when located at the same height as the car.

Further, in the above-mentioned examples, the machine-room-less elevator apparatus having the drive device disposed within the hoistway is described. However, the present invention is also applicable to an elevator apparatus having a machine room in which a drive device and a control panel are installed.

Furthermore, in the aforementioned examples, the drive device is disposed such that the rotary shaft of the drive sheave extends vertically or almost vertically. However, the disposition of the drive device is not limited to this. For example, the drive device maybe disposed such that the rotary shaft of the drive sheave extends horizontally.

Further, in the above-mentioned examples, the drive device is disposed such that the drive sheave is located in the upper portion of the drive device main body. Conversely, however, the drive device may also be disposed such that the drive sheave is located in the lower portion of the drive device main body.

Furthermore, in the above-mentioned examples, the drive device is disposed in the upper portion of the hoistway. However, the position of the drive device is not limited to this. For example, the drive device may also be disposed in the lower portion of the hoistway. Further, the present invention is also applicable to a self-propelled elevator apparatus having a drive device mounted in an upper or lower portion of a car.

Furthermore, for example, ropes having a circular cross-section, belt-like ropes, or the like can be employed as the main ropes.

Further, for example, steel ropes, resin-coated ropes having an outer layer coating member made of a high-friction resin material provided on an outer periphery portion thereof, or the like can be employed as the main ropes. The use of resin-coated ropes makes it possible to ensure a large traction force at a small winding angle. Further, the resin-coated ropes can enhance flexibility more than simple steel ropes and the diameter of the drive sheave can thus be reduced.

In addition, the components (drive device, return pulley, deflection pulley, and the like) disposed in the upper portion of the hoistway 1 may be unitized by being mounted on a common support frame.

Furthermore, the present invention is applicable to various elevator apparatuses such as an elevator of a one-shaft-multi-car elevator system and a double-deck elevator.

The invention claimed is:

1. An elevator apparatus comprising a car raised and lowered within a hoistway, the car having a car frame and a cage supported on the car frame, wherein:

the cage has a first and second pair of opposed corner portions and has a chamfered portion provided at each corner portion of the cage; and the car frame has a vertical column arranged along the chamfered portions of said first pair of opposed corner portions and has rope connecting portions along at least one of said second pair of opposed corner portions.

2. The elevator apparatus according to claim 1, wherein:

the chamfered portion comprises a first chamfered portion and a second chamfered portion which are located at diagonal positions of the cage; and the vertical column comprises a first vertical column disposed along the first chamfered portion, and a second vertical column disposed along the second chamfered portion.

3. The elevator apparatus according to claim 1, wherein:

the chamfered portion comprises a first chamfered portion and a second chamfered portion which are located at positions on one diagonal of the cage, and a third chamfered portion and a fourth chamfered portion which are located at positions on the other diagonal of the cage; and the vertical column comprises a first vertical column, a second vertical column, a third vertical column, and a fourth vertical column which are disposed along the first chamfered portion, the second chamfered portion, the third chamfered portion, and the fourth chamfered portion, respectively.

4. The elevator apparatus according to claim 2, further comprising a first car guide rail and a second car guide rail for guiding raising and lowering of the car, the first car guide rail and the second car guide rail being disposed within the hoistway in opposition to the first vertical column and the second vertical column, respectively.

5. The elevator apparatus according to claim 2, wherein the car frame is disposed between upper end portions of the first vertical column and the second vertical column, and has an upper beam that is disposed along a diagonal line of the car as seen in a vertical projection plane.

6. The elevator apparatus according to claim 2, wherein the car frame is disposed between lower end portions of the first vertical column and the second vertical column, and has a lower beam that is disposed along a diagonal line of the car as seen in a vertical projection plane.

7. The elevator apparatus according to claim 4, wherein the first vertical column and the second vertical column have attached thereto a first car guide shoe and a second car guide shoe which engage with the first car guide rail and the second car guide rail, respectively.

8. The elevator apparatus according to claim 4, wherein:

the first vertical column and the second vertical column each have a groove portion, which extends continuously in a vertical direction, formed in each of faces of the first vertical column and the second vertical column opposed to the first guide rail and the second guide rail, respectively; and a first car guide shoe and a second car guide shoe, which respectively engage with the first car guide rail and the second car guide rail, are each at least partially disposed within the groove portion.

9. The elevator apparatus according to claim 4, wherein:

the first vertical column and the second vertical column each have a groove portion, which extends continuously in a vertical direction, formed in each of faces of the first vertical column and the second vertical column opposed to the first guide rail and the second guide rail; respectively; and the first car guide rail and the second car guide rail are each at least partially disposed within the groove portion.

10. The elevator apparatus according to claim 4, further comprising a safety device mounted on the car and coming into engagement with the first car guide rail and the second car guide rail to bring the car into an emergency stop, wherein:

the first vertical column and the second vertical column each have a groove portion formed in each of faces of the first vertical column and the second vertical column opposed to the first car guide rail and the second car guide rail, respectively; and the safety device is at least partially disposed within the groove portion as seen in a vertical projection plane.

11. The elevator apparatus according to claim 3, wherein the car frame comprises a first upper beam disposed between upper end portions of the first vertical column and the second vertical column, and a second upper beam crossing the first upper beam and disposed between upper end portions of the third vertical column and the fourth vertical column.

12. The elevator apparatus according to claim 3, wherein the car frame comprises a first lower beam disposed between lower end portions of the first vertical column and the second vertical column, and a second lower beam crossing the first lower beam and disposed between lower end portions of the third vertical column and the fourth vertical column.

13. An elevator apparatus comprising a car raised and lowered within a hoistway, the car having: a car frame including a vertical column; and a cage supported on the car frame, wherein:

the cage has a recess provided in a side face thereof;

a protrusion is formed inside the cage due to the provision of the recess; and the vertical column is at least partially disposed within the recess.

* * * * *